US011525305B2

(12) United States Patent
Loucks

(10) Patent No.: US 11,525,305 B2
(45) Date of Patent: Dec. 13, 2022

(54) LADDER SAFETY STABILIZER

(71) Applicant: Robert Loucks, Altamont, NY (US)

(72) Inventor: Robert Loucks, Altamont, NY (US)

( * ) Notice: Subject to any disclaimer, the term of this patent is extended or adjusted under 35 U.S.C. 154(b) by 447 days.

(21) Appl. No.: 16/103,932

(22) Filed: Aug. 15, 2018

(65) Prior Publication Data

US 2020/0355029 A1 Nov. 12, 2020

Related U.S. Application Data

(60) Provisional application No. 62/546,002, filed on Aug. 16, 2017.

(51) Int. Cl.
*E06C 1/22* (2006.01)
*E06C 7/18* (2006.01)
*E06C 5/36* (2006.01)

(52) U.S. Cl.
CPC ..... *E06C 7/188* (2013.01); *E06C 5/36* (2013.01)

(58) Field of Classification Search
CPC ... E06C 7/188; E06C 5/36; E06C 7/48; E06C 7/482; E06C 7/484
See application file for complete search history.

(56) References Cited

U.S. PATENT DOCUMENTS 2,680,554 A * 6/1954 Dakin ..... E06C 7/48 182/120
3,459,277 A * 8/1969 Frederick ..... E06C 7/48 248/235
5,647,452 A * 7/1997 Gauthier ..... E06C 7/42 182/117
5,664,643 A * 9/1997 Taylor, Jr. ..... E06C 7/48 182/214
5,855,252 A * 1/1999 Vrolyks ..... E06C 7/48 182/214
6,089,350 A * 7/2000 Hankins ..... E06C 7/46 182/129
6,371,429 B1 * 4/2002 Gillespie ..... A47G 33/1246 248/354.1
6,427,803 B1 * 8/2002 Moore ..... E06C 7/48 248/210
6,883,642 B2 * 4/2005 Matty ..... E04G 1/38 182/117
7,445,086 B1 * 11/2008 Sizemore ..... E06C 7/081 182/108
7,743,886 B2 * 6/2010 Feemster, Jr. ..... E06C 7/46 52/156
8,047,330 B1 * 11/2011 English ..... E06C 7/48 182/117
9,038,778 B1 * 5/2015 Carter ..... E06C 7/44 182/187
9,109,395 B2 * 8/2015 Reitz ..... E06C 7/482
(Continued)

FOREIGN PATENT DOCUMENTS

DE 1434446 A1 * 2/1969 ..... E06C 7/48

*Primary Examiner* — Jerry E Redman
(74) *Attorney, Agent, or Firm* — Cramer Patent & Design, PLLC; Aaron R. Cramer

(57) ABSTRACT

A ladder safety stabilizer is a telescopically adjustable device that attaches to the rung of a ladder on one end and to the building that the ladder is leaning against at the other end to prevent the feet of the ladder from sliding while a user is climbing, and to provide a second stabilization point in addition to the feet of the ladder to provide greater ladder stability, increased safety, and reduced accident risk.

2 Claims, 4 Drawing Sheets

(56) References Cited

U.S. PATENT DOCUMENTS

| | | | | |
|---|---|---|---|---|
| 9,366,083 | B2 * | 6/2016 | Graham, Sr. | E06C 7/188 |
| 9,404,257 | B2 * | 8/2016 | Reno | E04G 21/1891 |
| 9,488,001 | B2 * | 11/2016 | Cherevko | E06C 1/06 |
| 9,771,756 | B1 * | 9/2017 | Gregoire | E06C 7/42 |
| 10,501,991 | B2 * | 12/2019 | Umlor | E06C 7/48 |
| 10,619,416 | B1 * | 4/2020 | Snell | E06C 7/06 |
| 2004/0089501 | A1 * | 5/2004 | Hockensmith | E06C 7/48<br>182/214 |
| 2011/0017549 | A1 * | 1/2011 | Lietz | E06C 7/423<br>182/172 |
| 2011/0315476 | A1 * | 12/2011 | Clarkson | E06C 7/48<br>182/107 |
| 2013/0068560 | A1 * | 3/2013 | Estep | E06C 7/188<br>182/107 |
| 2015/0152684 | A1 * | 6/2015 | Livermore | E06C 7/48<br>182/187 |
| 2016/0153234 | A1 * | 6/2016 | Mazanek | E06C 7/188<br>248/354.1 |
| 2017/0356245 | A1 * | 12/2017 | Surdo | E06C 7/48 |
| 2018/0171715 | A1 * | 6/2018 | Umlor | E06C 7/48 |

* cited by examiner

LADDER SAFETY STABILIZER

CROSS-REFERENCE TO RELATED APPLICATION

The present application is related to and claims priority from prior provisional application Ser. No. 62/546,002, filed Aug. 16, 2017 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of stabilizing devices and more specifically relates to a ladder safety stabilizer.

2. Description of the Related Art

A ladder is an invaluable tool used for climbing onto roofs and/or reaching heights that an individual cannot reach without help of some kind to perform maintenance above ground levels. For such occupations as construction workers, carpenters, contractors, and painters, these necessary devices provide accessibility to ordinarily inaccessible locations. People employed in the trades generally try to choose a ladder that will be suited for doing all of the anticipated tasks that may be encountered and sometimes must purchase more than one type of ladder. Homeowners and renters tend to perform as much of the maintenance around their homes as they have the ability and skills to do in order to save money, and the safe use of a ladder has become as important for them as well as it is for trades people. One problem with the use of ladders though is that it accounts for one of the largest categories of injuries and fatalities for at-home and for industrial accidents. The Occupational Health and Safety Administration (OSHA), a government agency that is concerned with on-the-job safety of workers, investigates, tracks, and categorizes accidents in the work place. One of the largest categories in their database is accidents involving ladders. OSHA does not track at-home injuries involving ladders but some private organizations maintain these statistics, which also indicate that it is the leading cause of death for at-home accidents.

There are multiple reasons why ladders can be very dangerous and it nearly always involve a lack of understanding of proper use, lack of patience in proper setup for use, uneven or unstable surface for the ladder to rest upon, improper inclination of the ladder in relation to the height of the object it rests against, or any combination of the above. While the ladder remains the safest and most cost effective method of performing maintenance at heights above arms reach, it can also be the most likely cause of injury or death in performing this type of maintenance. A solution is needed that will remove the risk involved in the use of ladders.

Various attempts have been made to solve the above-mentioned problems such as those found in U.S. Pub. No. 2008/0156584 to Joseph Anthony Simonetti; U.S. Pat. No. 3,903,991 to Phelan Richard D; and U.S. Pat. No. 6,427,803 to Scott A. Moore. This prior art is representative of ladder stabilizer devices. None of the above inventions and patents, taken either singly or in combination, is seen to describe the invention as claimed.

Ideally, a ladder stabilizer device should provide stabilization in relation to the building being climbed, and yet, would operate reliably and be manufactured at a modest expense. Thus, a need exists for a reliable ladder safety stabilizer to avoid the above-mentioned problems.

BRIEF SUMMARY OF THE INVENTION

In view of the foregoing disadvantages inherent in the known ladder stabilizer device art, the present invention provides a novel ladder safety stabilizer. The general purpose of the present invention, which will be described subsequently in greater detail, is to provide a stabilization of the ladder in relation to the building being climbed.

A ladder safety stabilizer preferably comprises an elongated shaft having a proximal end, a distal end, and a length that is measured from the proximal end to the distal end with the length of the elongated shaft being adjustable, a support mount including a plurality of spaced mounting holes at the distal end of the elongated shaft that is adapted to be releasably attached to a support structure, and a ladder mount including at least one ladder connector member that is connected to the proximal end of the elongated shaft and is adapted to be releasably attached to a ladder.

The ladder safety stabilizer is adapted to be connected between the ladder and the support structure to increase the stability of the ladder when in use. At least one fastener member is adapted to pass through one of the plurality of spaced mounting holes of the support mount to releasably connect the ladder safety stabilizer to the support structure. The fastener member is chosen from a group of fasteners consisting of screws, bolts, and nails. The support mount is formed as an elongated flat plate adapted to be placed against a flat surface of the support structure.

The elongated shaft is formed from two telescoping shaft members each that include a series of lock apertures therethrough and a releasable lock member that is adapted to releasably engage respective lock apertures of the two telescoping shaft members to thereby releasably hold the elongated shaft at a chosen length. The ladder mount is pivotally connected to the proximal end of the elongated shaft and the elongated shaft includes an adjustment connector adapted to releasably hold the ladder mount at a chosen angle to the elongated shaft.

At least one and preferably two ladder connector members that are formed as hook members that are adapted to releasably connect with the same chosen rung of the ladder. Each of the two spaced ladder connector members includes two spaced bolt apertures and a bolt member that is adapted to pass through the two spaced bolt apertures such that each of the two spaced ladder connector members are able to be releasably connected to the rung of the ladder. The elongated shaft includes an adjustment connector formed as a bolt and wing nut.

An improved ladder assembly may comprise an elongated ladder having two elongated side rails, spaced and parallel to one another and attached together via a plurality of perpendicularly spaced rungs, a ladder safety stabilizer comprising an elongated shaft including a proximal end, a distal end, and a length measured from the proximal end to the distal end with the length of the elongated shaft being adjustable, a support mount including a plurality of spaced mounting holes that is connected to the distal end of the elongated shaft that is adapted to be releasably attached to a support structure, and a ladder mount that includes at least one ladder connector member that is connected to the proximal end of the elongated shaft and adapted to be releasably attached to one of the rungs of the elongated ladder. The ladder safety stabilizer is adapted to be connected between the elongated ladder and the support structure to increase the stability of the elongated ladder when in use.

At least one fastener member is adapted to pass through one of the plurality of spaced mounting holes of the support mount to releasably connect the ladder safety stabilizer to the support structure. Fastener member(s) is/are chosen from a group of fasteners consisting of screws, bolts, and nails. The support mount is formed as an elongated flat plate adapted to be placed upon a flat surface of the support structure.

The elongated shaft is formed from two telescoping shaft members, the inner shaft including a series of lock apertures passing cross-wise through the center and the outer telescoping shaft member having one set of two aligned apertures positioned such that a releasable lock member, which is adapted to releasably engage respective lock apertures of the two telescoping shaft members, can thereby releasably hold the elongated shaft at a chosen length. The ladder mount is pivotally connected to the proximal end of the elongated shaft and includes an adjustment connector adapted to releasably hold the ladder mount at a chosen angle to the elongated shaft. The adjustment connector may be formed as a bolt and wing nut but may be formed as a pin and wire spring latch.

The ladder connector member(s) is/are formed as hook members adapted to releasably connect with a rung of the ladder. The spaced ladder connector members include two spaced bolt apertures, and a bolt member adapted to pass through the two spaced bolt apertures such that the at least one spaced ladder connector member is adapted to be releasably connected to the rung of the ladder. There are preferably two spaced ladder connector members.

The present invention holds significant improvements and serves as a ladder safety stabilizer. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, a ladder safety stabilizer, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a ladder stabilizer device and more particularly to a ladder safety stabilizer as used to improve the stabilization of the ladder in relation to the structure being climbed.

Generally speaking, a ladder safety stabilizer is a telescopically adjustable device that attaches to the rung of a ladder on one end and to the building that the ladder is leaning against at the other end to prevent the feet of the ladder from sliding while a user is climbing, and to provide a second stabilization point in addition to the feet of the ladder to provide greater ladder stability, increased safety, and reduced accident risk.

Figure 1:
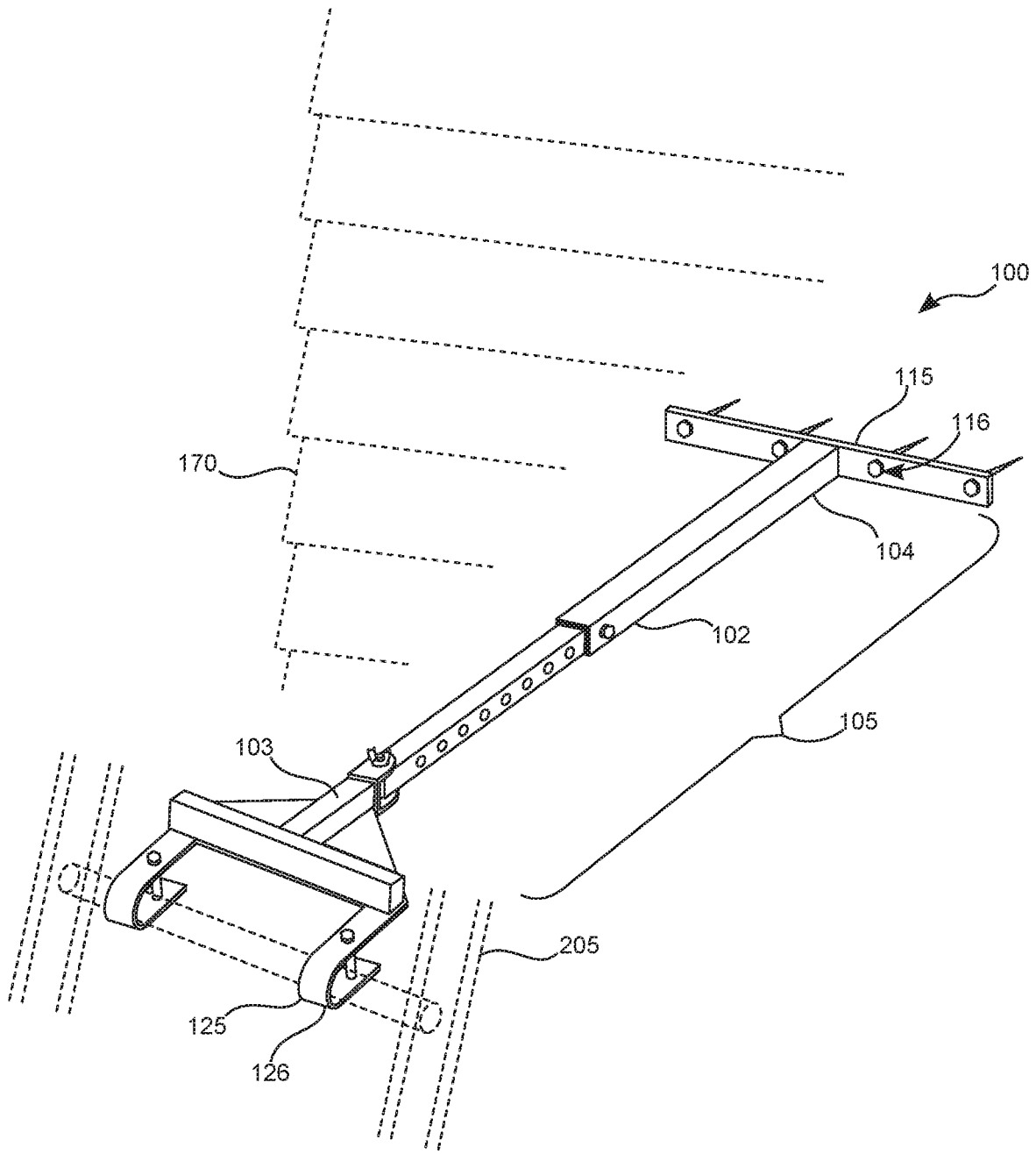
FIG. 1 shows a perspective view illustrating a ladder safety stabilizer according to an embodiment of the present invention.

Referring to the drawings by numerals of reference there is shown in FIG. 1, a perspective view illustrating ladder safety stabilizer 100 according to an embodiment of the present invention.

Ladder safety stabilizer 100 is adapted to be connected between ladder 205 and support structure 170 to increase the stability of ladder 205 when in use. Ladder safety stabilizer 100 will prevent the feet of ladder 205 from sliding outward when ladder 205 is placed on a smooth surface as well as limiting the inward bowing of a long ladder 205, such as a tall extension ladder 205, when the span between the top contact point between the ladder and support structure 170 and the bottom contact point (feet) of ladder 205 is considerable. It should be noted that the overall length of ladder safety stabilizer 100 may vary depending on need. A third advantage of ladder safety stabilizer 100 is that stability from having the top of ladder 205 slide laterally is also increased. On very tall ladders 205, using more than one ladder safety stabilizer 100 at different heights will greatly increase safety from having unwanted ladder 205 movement.

Ladder safety stabilizer 100 preferably comprises elongated shaft 102 having proximal end 103, distal end 104, and length 105 that is measured from proximal end 103 to distal end 104 with length 105 of elongated shaft 102 being adjustable, support mount 115 including a plurality of spaced mounting holes 116 at distal end 104 of elongated shaft 102 that is adapted to be releasably attached to support structure 170, and ladder mount 125 including at least one ladder connector member 126 that is connected to proximal end 103 of elongated shaft 102 and is adapted to be releasably attached to ladder 205.

Figure 2:
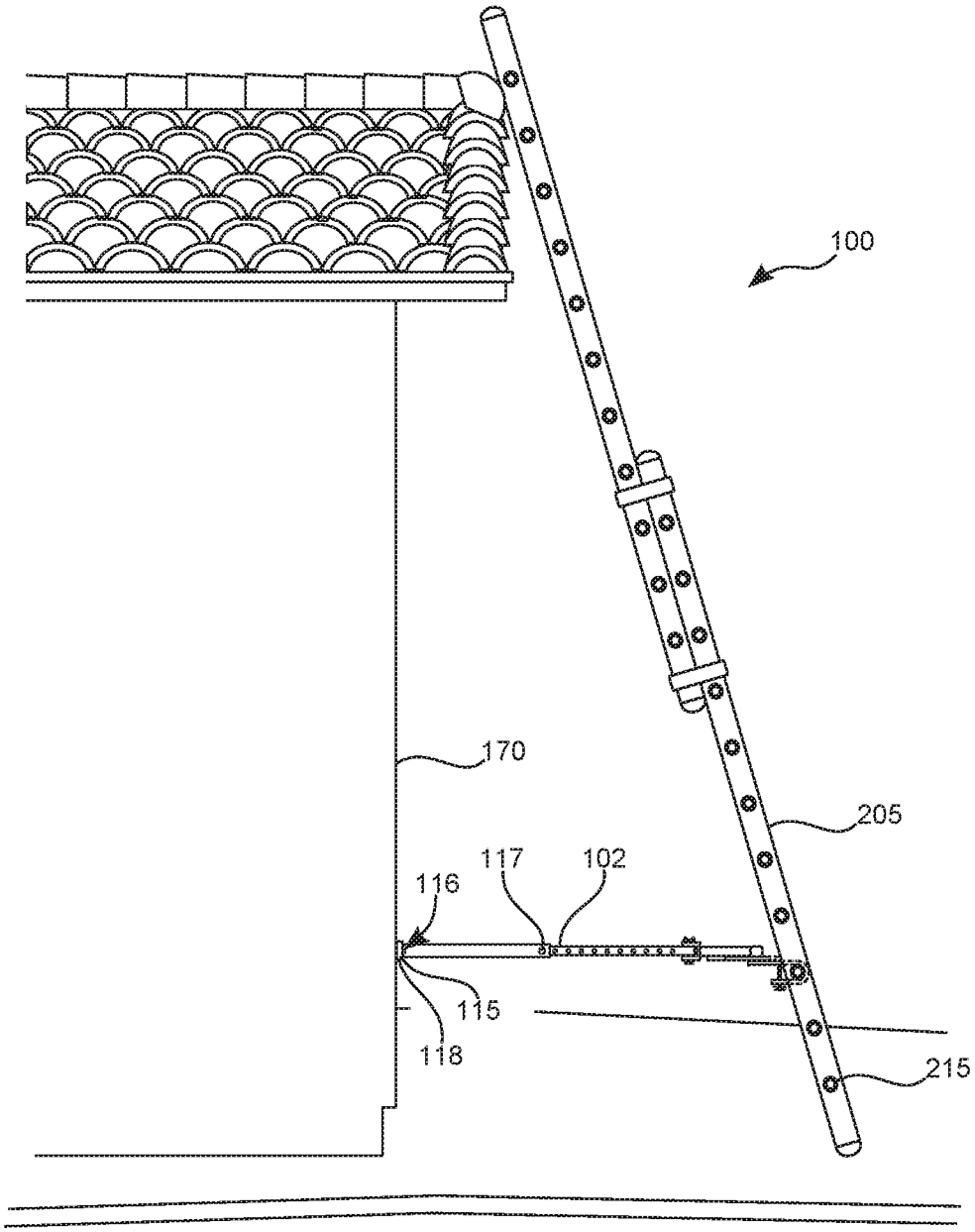
FIG. 2 is a side view illustrating a ladder safety stabilizer according to an embodiment of the present invention of FIG. 1.

Referring now to FIG. 2, is a side view illustrating ladder safety stabilizer 100 according to an embodiment of the present invention of FIG. 1

In this view, the proper angle at which to place ladder safety stabilizer 100 is shown, though different circumstances may dictate a few degrees variation from horizontal. Using more than one ladder safety stabilizer 100 may be advantageous at greater heights. The height that ladder safety stabilizer 100 is placed may vary by extending or retracting elongated shaft 102. The lower that ladder safety stabilizer 100 is placed to the ground surface or to the bottom rung 215 of ladder 205, the greater the extension length should be, and then the length should be locked by fastener member 117 which is adapted to pass through one of the plurality of spaced mounting holes 116 of support mount 115 to releasably connect ladder safety stabilizer 100 to support structure 170. Fastener member 117 is chosen from a group of fasteners consisting of screws, bolts, and nails but may also be a pin and wire spring latch. Support mount 115 is formed as elongated flat plate 118 adapted to be placed against a flat surface of support structure 170 and fastened to support structure 170.

Figure 3:
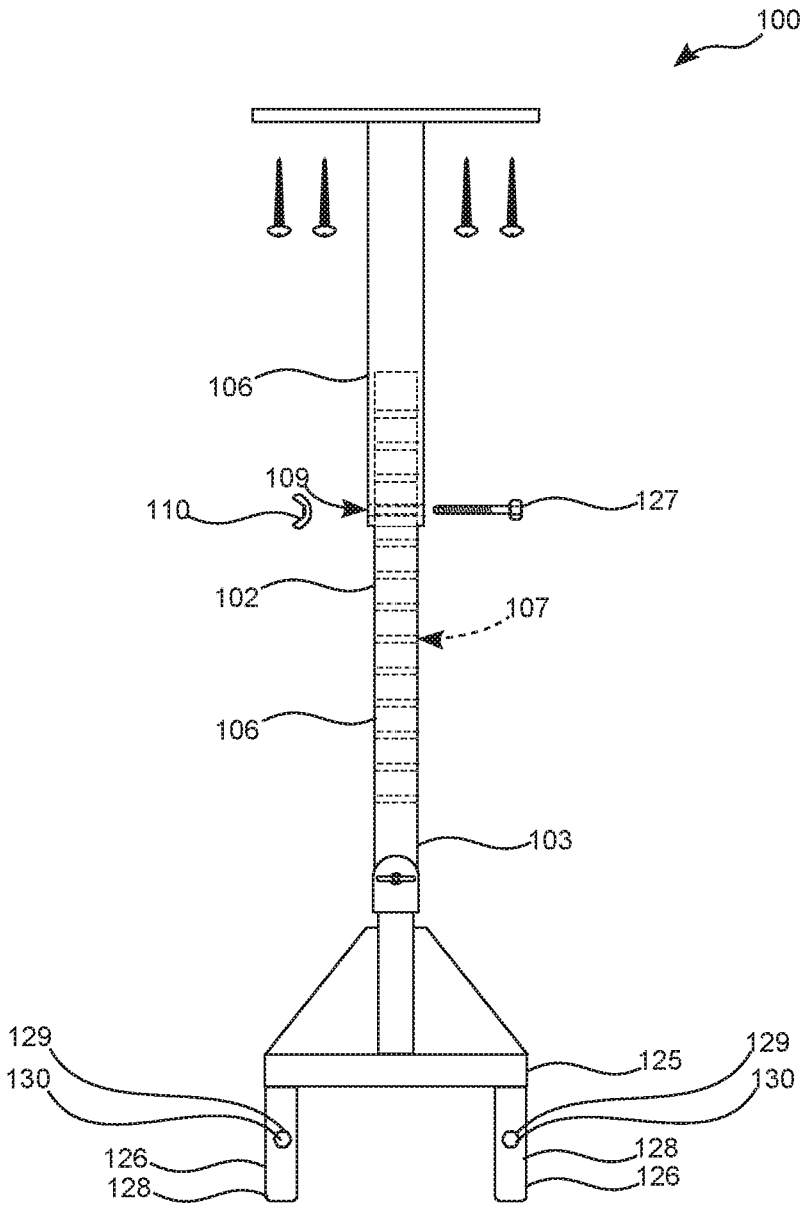
FIG. 3 is a top view illustrating ladder safety stabilizer according to an embodiment of the present invention of FIG. 1.

Referring now to FIG. 3, is a top view illustrating ladder safety stabilizer 100 according to an embodiment of the present invention of FIG. 1.

Elongated shaft 102 is formed from two telescoping shaft members 106 each that include a series of lock apertures 107 therethrough and releasable lock member 108 that is adapted to releasably engage respective lock apertures 107 of the two telescoping shaft members 106 to thereby releasably hold elongated shaft 102 at a chosen length. Ladder mount 125 is pivotally connected to proximal end 103 of elongated shaft 102 and elongated shaft 102 includes adjustment connector 109 adapted to releasably hold ladder mount 125 at a chosen angle to elongated shaft 102.

Figure 4:
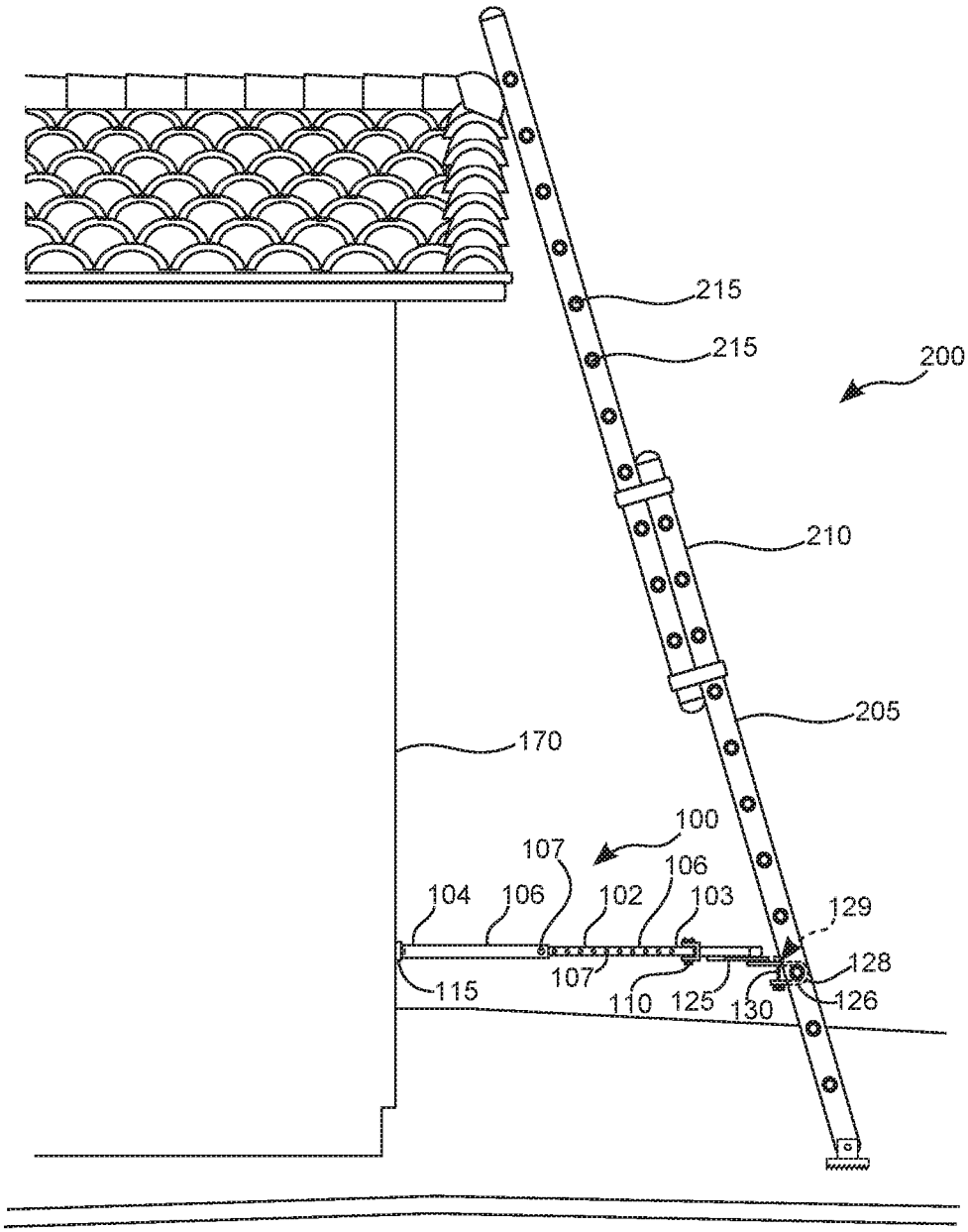
FIG. 4 is a perspective view illustrating the improved ladder assembly according to an embodiment of the present invention of FIG. 1.

At least one and preferably two ladder connector members 126 that are formed as hook members 128 that are adapted to releasably connect with the same chosen rung 215 (FIG. 2 and FIG. 4) of ladder 205. Each of the two spaced ladder connector members 126 includes two spaced bolt apertures 129 and bolt member 130 that is adapted to pass through the two spaced bolt apertures 129 such that each of the two spaced ladder connector members 126 are able to be releasably connected to rung 215 (FIG. 2 and FIG. 4) of ladder 205 (FIG. 2 and FIG. 4). Elongated shaft 102 includes adjustment connector 127 formed as bolt and wing nut 110. The two ladder connector members 126 that are formed as hook members 128 curl downward to facilitate receiving releasably connected said rung of the ladder.

Referring now to FIG. 4, is a perspective view illustrating improved ladder assembly 200 according to an embodiment of the present invention of FIG. 1.

Improved ladder assembly 200 may comprise ladder 205 having two elongated side rails 210, spaced and parallel to one another and attached together via a plurality of perpendicularly spaced rungs 215, ladder safety stabilizer 100 comprising elongated shaft 102 including proximal end 103, distal end 104, and length 105 measured from proximal end 103 to distal end 104 with the length of elongated shaft 102 being adjustable, support mount 115 including a plurality of spaced mounting holes 116 that is connected to distal end 104 of elongated shaft 102 that is adapted to be releasably attached to support structure 170, and ladder mount 125 that includes at least one ladder connector member 126 that is connected to proximal end 103 of elongated shaft 102 and adapted to be releasably attached to one of rung 215 of the elongated ladder 205. Ladder safety stabilizer 100 is adapted to be connected between the elongated ladder 205 and support structure 170 to increase the stability of ladder 205 when in use.

At least one fastener member 117 is adapted to pass through one of the plurality of spaced mounting holes 116 of the support mount to releasably connect ladder safety stabilizer 100 to support structure 170. Fastener members 117 is/are chosen from a group of fasteners consisting of screws, bolts, and nails. Support mount 115 is formed as elongated flat plate 118 adapted to be placed upon a flat surface of support structure 170.

Elongated shaft 102 is formed from two telescoping shaft members 106, the inner elongated shaft 102 including a series of lock apertures 107 passing cross-wise through the center and the outer telescoping shaft members 106 having one set of two aligned lock apertures 107 positioned such that releasable lock member 108, which is adapted to releasably engage respective lock apertures 107 of the two telescoping shaft members 106, can thereby releasably hold elongated shaft 102 at a chosen length. Ladder mount 125 is pivotally connected to proximal end 103 of elongated shaft 102 and includes adjustment connector 109 adapted to releasably hold ladder mount 125 at a chosen angle to elongated shaft 102. Adjustment connector 109 may be formed as bolt and wing nut 110 but may be formed as a pin and wire spring latch.

Ladder connector member 126 is/are formed as hook members 128 adapted to releasably connect with rung 215 of ladder 205. The spaced ladder connector members 126 include two spaced bolt apertures 129, and bolt member 130 adapted to pass through the two spaced bolt apertures 129 such that the at least one spaced ladder connector members 126 is adapted to be releasably connected to rung 215 of ladder 205. There are preferably two spaced ladder connector members 126.

Ladder safety stabilizer 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

The invention claimed is:

1. A ladder safety stabilizer, consisting of:

an elongated shaft, including:

a proximal end;

a distal end;

a length;

wherein said length is measured from said proximal end to said distal end;

wherein said length of said elongated shaft is adjustable;

a support mount, including:

a plurality of spaced mounting holes;

wherein said support mount is connected to said distal end of said elongated shaft and is adapted to be releasably attached to a support structure; and a ladder mount, including:

at least one ladder connector member;

at least one fastener member adapted to pass through one of said spaced mounting holes of said support mount to releasably connect said ladder safety stabilizer to said support structure;

wherein said ladder mount is connected to said proximal end of said elongated shaft and is adapted to be releasably attached to a ladder;

wherein said ladder safety stabilizer is adapted to be connected between said ladder and said support structure to increase the stability of said ladder when in use;

wherein said support mount is formed as an elongated flat plate adapted to be placed upon a flat surface of said support structure;

wherein said ladder mount is pivotally connected to said proximal end of said elongated shaft, said elongated shaft includes an adjustment connector adapted to releasably hold said ladder mount at a chosen angle to said elongated shaft;

wherein said at least one ladder connector member is formed as a hook member adapted to releasable connect with a rung of said ladder;

wherein said elongated shaft includes an adjustment connector formed as a bolt and wing nut;

wherein at least one spaced ladder connector member includes two spaced bolt apertures and a bolt member is adapted to pass through said two spaced bolt apertures such that said at least one spaced ladder connector member is adapted to be releasably connected to said rung of said ladder;

wherein said at least one ladder connector member curls downward to facilitate receiving releasably connected said rung of the ladder; and wherein said at least one fastener member is selected from the group consisting of at least one screw, at least one bolt, or at least one nail.

2. An improved ladder assembly, consisting of:

an elongated ladder, including:

two elongated side rails;

wherein said two elongated side rails are spaced and parallel to one another; and a plurality of rungs;

wherein said rungs are spaced from one another and respectively connected between said two elongated side rails; and a ladder safety stabilizer, comprising:

an elongated shaft, including:

a proximal end;

a distal end;

a length;

wherein said length is measured from said proximal end to said distal end;

wherein said length of said elongated shaft is adjustable;

a support mount, including:

a plurality of spaced mounting holes;

wherein said support mount is connected to said distal end of said elongated shaft and is adapted to be releasably attached to a support structure; and a ladder mount, including:

at least one ladder connector member;

at least one fastener member adapted to pass through one of said spaced mounting holes of said support mount to releasably connect said ladder safety stabilizer to said support structure;

wherein said ladder mount is connected to said proximal end of said elongated shaft and is adapted to be releasably attached to one of said rungs of said elongated ladder;

wherein said support mount is formed as an elongated flat plate adapted to be placed upon a flat surface of said support structure;

wherein said ladder safety stabilizer is adapted to be connected between said elongated ladder and said support structure to increase the stability of said elongated ladder when in use;

wherein said ladder mount is pivotally connected to said proximal end of said elongated shaft;

wherein said elongated shaft includes an adjustment connector adapted to releasably hold said ladder mount at a chosen angle to said elongated shaft;

wherein said elongated shaft includes said adjustment connector formed as a bolt and wing nut;

wherein said at least one ladder connector member is formed as a hook member adapted to releasable connect with a rung of said ladder;

wherein at least one spaced ladder connector member includes two spaced bolt apertures and a bolt member is adapted to pass through said two spaced bolt apertures such that said at least one spaced ladder connector member is adapted to be releasably connected to said rung of said ladder;

wherein said at least one ladder connector member curls downward to facilitate receiving releasably connected said rung of the ladder;

wherein said at least one spaced ladder connector member curls downward to facilitate receiving releasably connected said rung of the ladder; and wherein said at least one fastener member is selected from the group consisting of at least one screw, at least one bolt, and at least one nail.

* * * * *